US007819787B2

(12) United States Patent
Kassel

(10) Patent No.: US 7,819,787 B2
(45) **Date of Patent: *Oct. 26, 2010**

(54) RESISTANCE TRAINING EXERCISE DEVICE, SYSTEM AND METHOD

(75) Inventor: Blake Kassel, Boca Raton, FL (US)

(73) Assignee: Bodylastics International, Inc., Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/546,085

(22) Filed: Aug. 24, 2009

(65) Prior Publication Data

US 2010/0167885 A1 Jul. 1, 2010

Related U.S. Application Data

(63) Continuation-in-part of application No. 12/344,798, filed on Dec. 29, 2008.

(51) Int. Cl.
*A63B 21/02* (2006.01)
*A44B 11/25* (2006.01)

(52) U.S. Cl. ..... 482/122; 482/121; 482/126; 24/300

(58) Field of Classification Search ..... 482/122, 482/124, 126, 129, 904, 121; 113/769, 770, 113/792, 798; 24/300
See application file for complete search history.

(56) References Cited

U.S. PATENT DOCUMENTS 1,112,114 A 9/1914 Caines
1,538,845 A * 5/1925 Titus ..... 482/126
4,815,731 A * 3/1989 Suarez et al. ..... 482/124
5,800,322 A 9/1998 Block
6,202,263 B1 3/2001 Harker
6,402,668 B1 6/2002 Harker
6,524,226 B2 2/2003 Kushner
6,692,415 B1 2/2004 Winston
6,860,841 B1 3/2005 Mortorano
6,979,286 B1 12/2005 Hinds
7,004,892 B2 * 2/2006 Marco ..... 482/124
7,041,040 B2 5/2006 Dovner et al.
7,044,896 B2 5/2006 Hetrick
7,090,622 B2 8/2006 Hetrick
7,326,157 B2 2/2008 Wu
7,344,485 B1 3/2008 Simpson et al.
7,357,762 B1 4/2008 Terry et al.
7,418,926 B2 9/2008 Kung
7,448,990 B2 11/2008 Wu
7,455,632 B2 11/2008 Block et al.
7,458,135 B2 * 12/2008 Mikesell et al. ..... 24/300
7,503,883 B2 3/2009 Madden
2004/0180767 A1 * 9/2004 Carmel et al. ..... 482/126
2005/0137066 A1 * 6/2005 Wu ..... 482/126
2007/0101950 A1 * 5/2007 Medlin ..... 119/792

* cited by examiner

*Primary Examiner*—Loan Thanh
*Assistant Examiner*—Allana Lewin
(74) *Attorney, Agent, or Firm*—Dan M. De La Rosa

(57) ABSTRACT

A resistance training exercise device, system and method having at least one elastic, elongated and hollow cord with a tether secured to each end of the cord and a limit band in the 3 cord to limit the length that the cord may be stretched.

21 Claims, 14 Drawing Sheets

RESISTANCE TRAINING EXERCISE DEVICE, SYSTEM AND METHOD

CROSS REFERENCE TO RELATED APPLICATIONS

This application is a continuation-in-part of U.S. Ser. No. 12/344,798 filed Dec. 29, 2008. The disclosure of the above application is incorporated herein by reference.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to a resistance training exercise device and method, and more particularly, to a resistance training exercise device and method employing interchangeable handles and straps for facilitating a variety of different exercises regardless of location.

2. Description of the Background Art

Resistance training is a popular form of exercise. Resistance training exercise devices known consist of a stretchable tube or cord with a pair of handles secured to opposing ends of the tube. To use this type of device, the user holds the handles and repeatedly stretches the tube, increasing the tension force in the tube, and retracts the tube while maintaining tension in the tube. However, resistance training devices such as these are very limited in application and structure and tend to break when stretched beyond the cords capacity.

One problem with conventional resistance training tubes is that the handles are connected the tube and they lack a reliable and effective mechanism to prevent the cord from stretching beyond a predetermined distance. For instance, U.S. Pat. No. 5,800,322, issued to Block, discloses an exercise device having a stretchable and elongated tube with a pair of handles secured to respective ends of the tube. As the handles are secured directly to the tube, the tube can only be used with those handles and cannot be replaced with different handles or straps or secured to a stationary object, such as a door knob or wall hook, to accommodate a variety of exercises. In addition, if the handle or tube breaks the entire device must be replaced. Moreover, connecting a handle directly to a tube raises structural integrity issues. U.S. Pat. No. 6,202,263, issued to Harker, discloses an exterior safety sleeve mounted over an elastic device to prevent a user from stretching the elastic member beyond a safe elongation. However, since the Harker device comprises a safety sleeve mounted over the elastic member it impedes exercise, is obstructive, too bulky for convenient storage and use and structurally weak. Other known devices that fail to adequately address or resolve the issues with traditional resistance training cord devices include those disclosed in U.S. Pat. Nos. 7,418,926; 7,458,135; 7,503,883; 7,455,632; 7,448,990; 7,357,762; 7,344,485; 7,326,157; 7,090,622; 7,044,896; 7,041,040; 6,979,286; 6,860,841; 6,692,415; 6,524,226; 6,402,668; 5,800,322 and 1,112,114.

If a resistance training exercise cord device and system existed that accommodated the universal use of a plurality of different handles and straps with interchangeable elastic cords of varying levels of elasticity to change the work load and with a non-obstructive mechanism for limiting the length of the stretch to prevent the cord from breaking, it would be more cost effective and versatile compared to conventional devices and, hence, well received. Unfortunately, there are no known resistance training exercise devices or systems that effectively and adequately meet these parameters. Accordingly, there exists a need for such a device and system. The instant invention addresses this unfulfilled need in the prior art by providing a resistance training exercise device, system and method as contemplated by the instant invention disclosed herein.

SUMMARY OF THE INVENTION

In light of the foregoing, in one embodiment, the present invention relates to a resistance training cord device having a plurality of interchangeable handles and straps.

In another embodiment, the present invention also relates to a resistance training elastic cord device having a tethered clip for interchanging handles, straps, bars, ropes and, or other components.

In yet another embodiment, the present invention provides for a resistance training elastic cord device having a clip tethered at each end of the cord for interchanging handles and straps.

In still another embodiment, the present invention relates to a resistance training elastic cord device having a clip tethered to each end of the cord by a structurally reinforced tether secured to each end of the cord.

In still yet another embodiment, the invention also relates to a resistance training elastic cord system having a plurality of interchangeable cords of varying elasticity, handles and straps.

In a further embodiment, the present invention provides for a method for using the resistance training elastic cord system for providing resistance exercise to enhance muscle strength and tone.

In yet a further embodiment, the present invention relates to a resistance training elastic cord device and system that is cost effective and convenient to use.

In still a further embodiment, the present invention provides for a resistance training elastic cord device having a limit mechanism that prevents stretching the device beyond a certain distance so it does not break.

In another further embodiment, the present invention further provides for a resistance training elastic cord device having a limit mechanism that does not interfere with a workout or result in a bulky device.

The instant invention provides a resistance training exercise device, system and method comprising at least one elastic, elongated and hollow cord with a tether secured to each end of the cord and a clip secured to the free end of each tether. The cord comprises a rubber or rubber like material having a predetermined level of elasticity. It is the level of elasticity that dictates the tension force of the cord in pounds. Accordingly, the cord is assigned an average workout weight in pounds, which is marked on the cord's corresponding clip. Each tether is secured to their respective end of the cord by a grommet, plug and sleeve. The plug is inserted in each cord end to prevent the grommet from slipping off the cord. The sleeve fits around the plug and the end of the cord containing the plug. The sleeve may comprise a separate component or the end of the cord folded back over itself and the plug. The clips preferably comprise an o-ring that receives the free end of the tether and a spring-loaded biasing flange for clipping onto a handle, strap or the cord itself. The handles and straps each comprise an o-ring for clasping by the clip. The handles are covered with foam for comfort. Likewise, the straps are padded for comfort.

In an alternative embodiment, the resistance training exercise device comprises a limit mechanism secured inside the elastic cord to prevent the cord from being stretched beyond a certain distance. The limit mechanism or band comprises a thin fabric or semi-elastic material having less elasticity or being substantially inelastic to stop the cord from stretching beyond the length of the band or predetermined point. The limit band preferably has some elasticity, but less than the cord, so it does not bunch up in a relaxed cord. The limit band also has a higher tensile strength than the elastic cord.

The system of the instant invention preferably comprises a plurality of cords with a clip tethered to each end, plurality of handles, and plurality of ankle or wrist straps. Each cord comprises a different level of elasticity or tension force measured in pounds for facilitating a desired workout Each cord is preferably color coded to indicate the "weight" of the cord. The system of the instant invention may further comprise a travel bag, user manual, workout guide and, or training video or DVD.

The method of resistance training in accordance with the instant invention comprises various exercises utilizing one or more cords and one or more handles or straps. The handles are used for stretching the cord with the hands. The straps are mounted to the wrists, ankles or stationary objects for stretching the cord. The user first determines the exercise to be performed. The user may reference the manual and guide for determining and designing exercise routines. Based on the exercise, the appropriate cord and handles or straps are selected and clipped to the tether or a clip may be clipped to the cord. Once the cord is properly prepared, a variety of exercises may be performed by stretching the cord and slowing retracting the cord to controllably release tension. For instance, the user may grasp a handle with each hand and stretch and slowly retract the cord across the chest, or stand in the middle of the cord and stretch the cord upward and outward. The user may clip one end of the cord to a door handle or hook and grasp a handle at the other end with one hand for repeatedly stretching the cord by pulling outward. The user may clip one end of the cord to a door handle or door anchor device and secure an ankle strap to the cord at the other end and place it around an ankle for repeatedly stretching the cord by moving the leg outward. The cord may be secured to a stationary object at one end by wrapping it around the stationary device and clipping it to itself.

In one embodiment, the present invention provides for an exercise device comprising: a stretchable cord having opposing first and second ends, the cord has an internal cavity and an external surface; at least two plugs, each plug is inserted within the internal cavity of the cord adjacent the first and second ends of the cord; at least two sleeves, each of the sleeves being placed over the external surface of the cord adjacent the first and second ends of the cord, each of the plugs is situated within a length of each of the sleeves; at least two tethers, each of the tethers has a stitched portion, the stitched potion forming two opposing compartments, a first compartment having at least one grommet and is designed to received at least one end of the cord with the sleeve and the plug, the grommet has a circumference that is smaller than a circumference of the cord with the sleeve, and the plug with at least a portion of said cord and at least a portion of said sleeve is situated generally within the first compartment of the tether; at least two carabineers, each of the carabineers has a bottom portion and a gate element; and at least two O-rings situated within each of the bottom portions of each of the carabineers, each of the O-rings is designed to receive a portion of the second compartment of each of the tethers.

In another embodiment, the present invention relates to a resistance exercise device comprising: a stretchable cord having opposing first and second ends, the cord has an internal cavity and an external surface; at least one plug is inserted within the internal cavity of the cord adjacent the first end of the cord; at least one sleeve is placed over the external surface of the cord adjacent the first end of the cord, the plug is situated within a length of the sleeve; at least one tether having a stitched portion, the stitched potion forms two opposing compartments, a first compartment has at least one grommet and is designed to received at least one end of the cord with the sleeve and the plug, the plug with at least a portion of the cord and at least a portion of the sleeve is situated generally within the first compartment of the tether, the second compartment forms a loop; at least one carabineer has a bottom portion and a gate element; and at least one O-ring is situated within the bottom portion of the carabineer, the O-ring is designed to receive a portion of the loop of the second compartment of the tether.

In a further embodiment, the present invention relates to a resistance exercise device comprising: a stretchable cord has opposing first and second ends, the cord has an internal cavity and an external surface, each of the first and second ends is folded over itself to create double layered ends; at least one plug is inserted within the internal cavity of the cord adjacent the first end of the cord, the plug is situated within a length of the double layered cord; at least one tether has a stitched portion, the stitched potion forms two opposing compartments, a first compartment has at least one grommet and is designed to received at least one end of the cord with the plug, the plug with at least a portion of the cord and at least a portion of the double layered cord is situated generally within the first compartment of the tether, the second compartment forms a loop; at least one carabineer has a bottom portion and a gate element; and at least one O-ring is situated within the bottom portion of the carabineer, the O-ring is designed to receive a portion of the loop of the second compartment of the tether.

In still another embodiment, the present invention provides for an exercise device comprising: a stretchable cord having opposing first and second ends, the cord having an internal cavity and an external surface; at least two sleeves, each of the sleeves being placed over the external surface of the cord adjacent the first and second ends of the cord, each of the plugs being situated within a length of each of the sleeves; at least two tethers, each of the tethers has a stitched portion, the stitched potion forms two opposing compartments, a first compartment has at least one grommet and is designed to received at least one end of the cord with the sleeve, the grommet has a circumference that is smaller than a circumference of the cord with the sleeve, at least a portion of the cord and at least a portion of the sleeve are situated generally within the first compartment of the tether; at least two carabineers, each of the carabineers has a bottom portion and a gate element; at least one limit band situated within the internal cavity of the cord; and a means for securing the limit band within the internal cavity of the cord, the means is situated within the cord and the sleeve.

In yet another embodiment, the present invention relates to a resistance exercise device comprising: a stretchable cord having opposing first and second ends, the cord has an internal cavity and an external surface; at least one plug is inserted within the internal cavity of the cord adjacent the first end of the cord; at least one sleeve is placed over the external surface of the cord adjacent the first end of the cord, the plug is situated within a length of the sleeve; at least one tether has a stitched portion, the stitched potion forms two opposing compartments, a first compartment has at least one grommet and is designed to received at least one end of the cord with the sleeve and the plug, the plug with at least a portion of the cord and at least a portion of the sleeve is situated generally within the first compartment of the tether, the second compartment forms a loop; at least one carabineer having a bottom portion and a gate element; and at least one limit band is situated within the internal cavity of the cord, the limit band has opposing ends, at least a portion of the first end of the limit band is secured to the plug.

In still yet another embodiment, the present invention discloses a resistance exercise device comprising: a stretchable cord having opposing first and second ends, the cord has an internal cavity and an external surface, each of the first and second ends is folded over itself to create double layered ends; at least one plug is inserted within the internal cavity of the cord adjacent the first end of the cord, the plug is situated within a length of the double layered cord; at least one tether has a stitched portion, the stitched potion forms two opposing compartments, a first compartment has at least one grommet and is designed to received at least one end of the cord with the plug, the plug with at least a portion of the cord and at least a portion of the double layered cord is situated generally within the first compartment of the tether, the second compartment forms a loop; at least one carabineer has a bottom portion and a gate element; and at least one limit band is situated within said internal cavity of said cord.

In a further embodiment, the present invention teaches a resistance exercise device comprising: a stretchable cord having opposing first and second ends, said cord has an internal cavity and an external surface; at least two sleeves, each of said sleeves is placed over the external surface of the cord adjacent the first and second ends of the cord, each of the plugs is situated within a length of each of the sleeves; at least two tethers, each of the tethers has a stitched portion, the stitched potion forms two opposing compartments, a first compartment has at least one grommet and is designed to received at least one end of the cord with the sleeve, the grommet has a circumference that is smaller than a circumference of the cord with the sleeve, at least a portion of the cord and at least a portion of the sleeve are situated generally within the first compartment of the tether; at least two carabineers, each of the carabineers has a bottom portion and a gate element; and at least one limit band is situated within the internal cavity of the cord, the limit band has opposing ends, at least one end of the limit band is attached to the bottom portion of one of the carabineers.

In accordance with these and other embodiments, the present invention will now be described with particular reference to the accompanying drawings.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Figure 1:
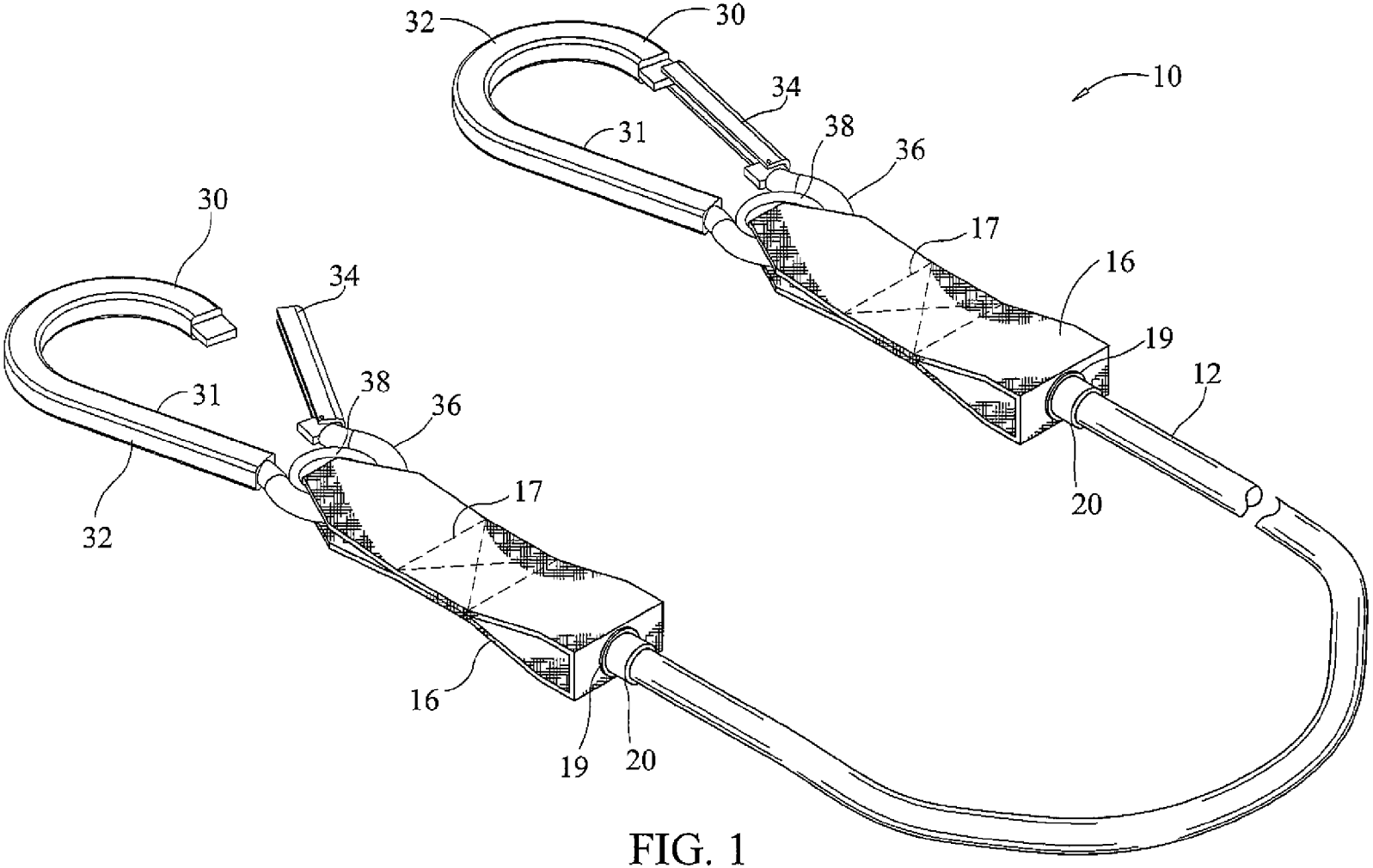
FIG. 1 is a perspective view of the resistance training exercise device in accordance with another embodiment of the instant invention.
Figure 2:
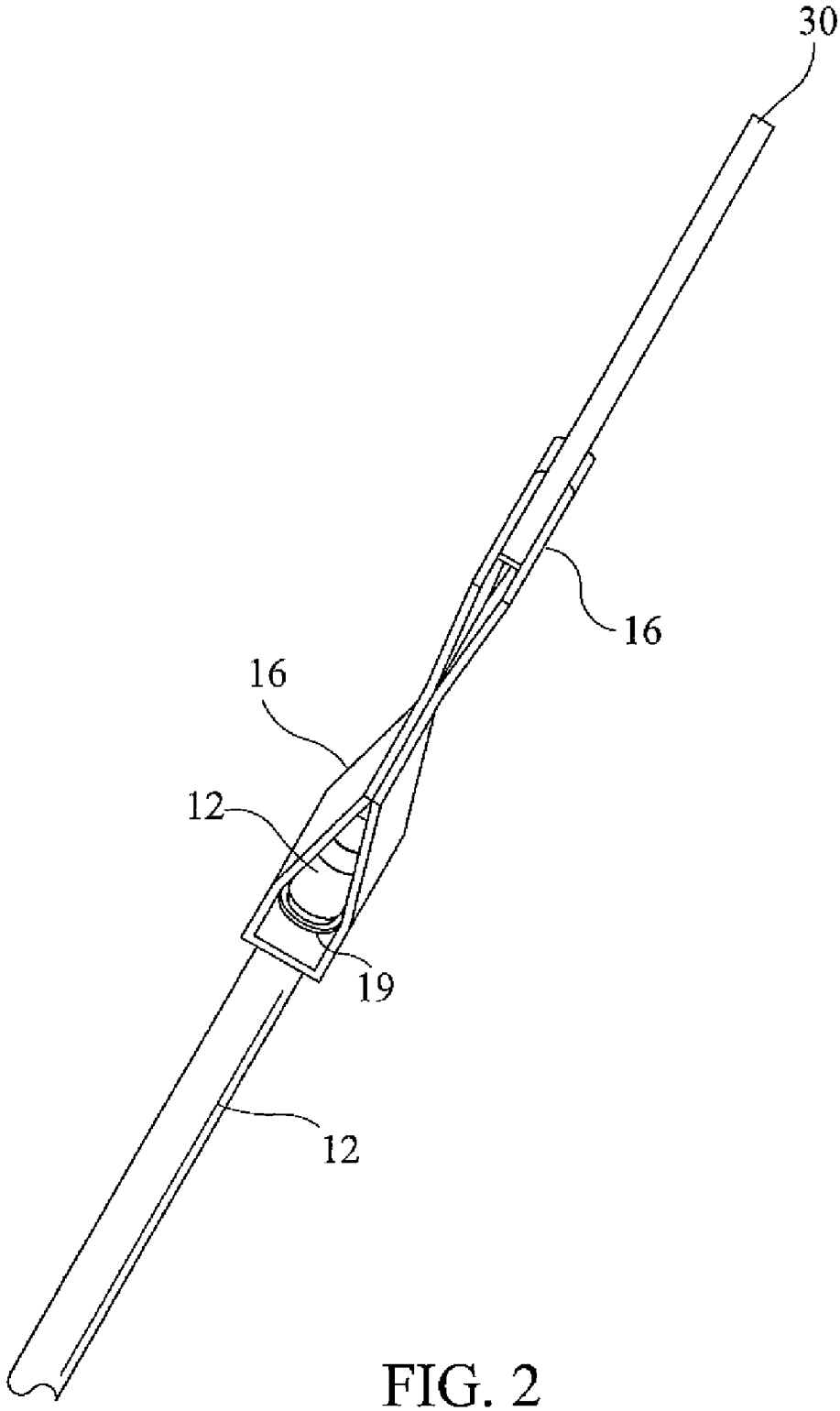
FIG. 2 is a side perspective view of the resistance training exercise device in accordance with another embodiment of the instant invention.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

With reference to the drawings, FIGS. 1 to 21C depict various embodiments of the instant invention which is generally referenced as a resistance training exercise device, system or method and, or by numeric character 10. The instant invention 10 comprises a resistance training exercise device, system and method that enables multiple exercises by providing and facilitating use of a plurality of interchangeable cords, handles and straps.

With reference to FIGS. 1-21C, various embodiments of the resistance training exercise device 10 of the instant invention comprises an elastic, elongated and hollow cord 12, a tether 16 secured to each end of the cord 12 and a clip 30 secured to the free end of each tether 16. The cord 12 comprises a rubber or rubber like material having a predetermined level of elasticity corresponding to the amount of pulling force needed to stretch to the cord a certain distance. The level of elasticity resistance in the cord dictates the tension force of the cord, which is represented in pounds. Accordingly, the cord 12 is designed with an average workout weight in pounds based on the cords modules of elasticity, which is indicated on the cord's corresponding clip 30 by indicia 31. Each tether 16 preferably comprises a nylon or nylon-like material that is secured to a corresponding end of the cord 12. Each tether 16 is sewn with stitching 17 in a mid-section to form a loop at each end for receiving and holding a corresponding clip 30 end and cord end 12, respectively. A clip 30 is secured to the free end of each tether 16 for attaching to a handle 40, ankle or wrist strap 50, rope, bar or other attachment or to the cord 12. The handle 40 preferably comprises an o-ring 42 for connecting to the clip 30, a support extension 43 with a loop for receiving and containing the o-ring 42 and a foam pad 44 around the gripping portion of the handle 40. Likewise, the ankle or wrist strap 50 preferably comprises an o-ring 52 for connecting to the clip 30, a support extension 53 with a loop for receiving and containing the o-ring 52 and a padded belt 54 for receiving and engaging an ankle or wrist.

Figure 3:
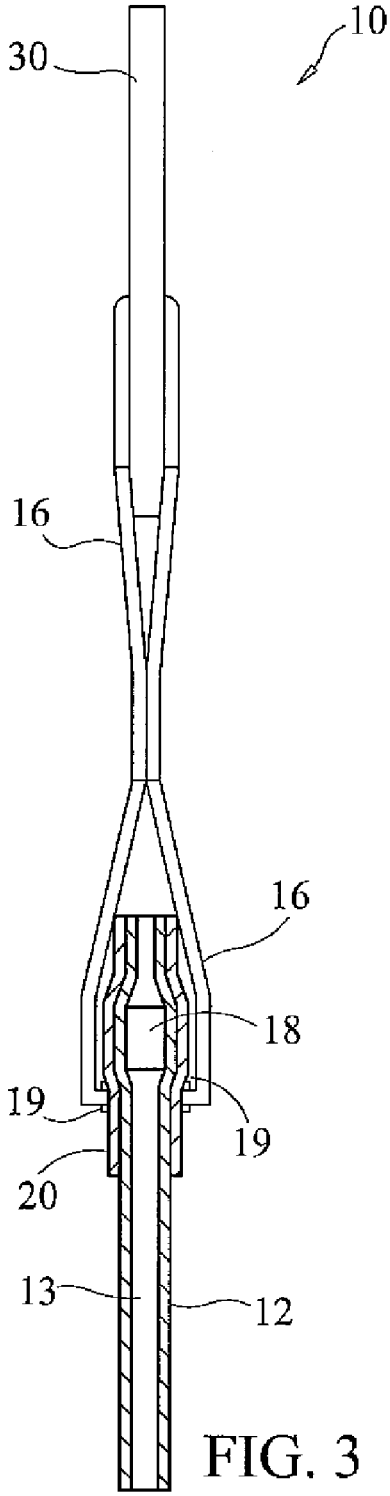
FIG. 3 is a partial cross-sectional view and elevational view of the resistance training exercise device in accordance with another embodiment of the instant invention.
Figure 4:
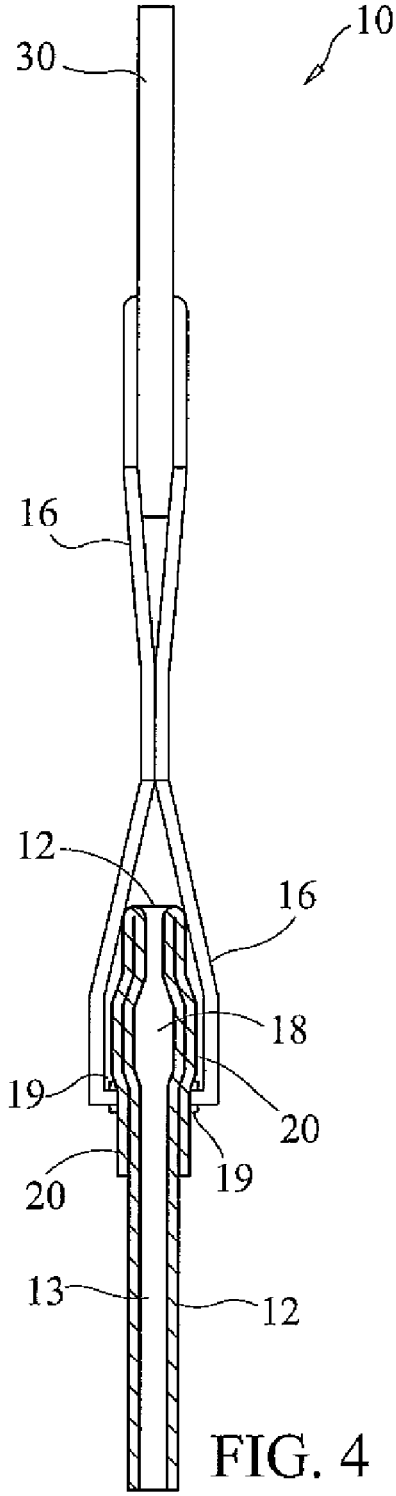
FIG. 4 is a partial cross-sectional view and elevational view of the resistance training exercise device in accordance with the alternative embodiment of the instant invention.
Figure 5:
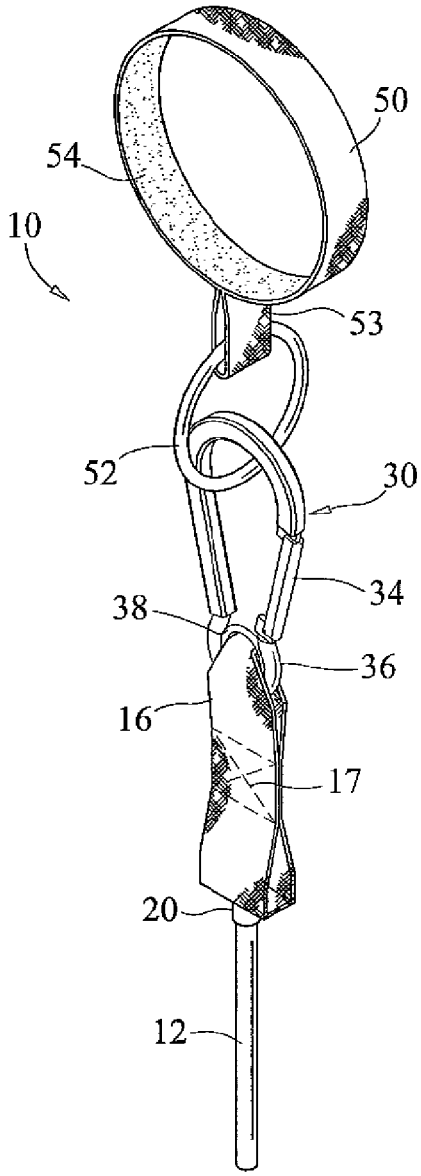
FIG. 5 is a perspective view of the resistance training exercise device with an ankle or wrist strap in accordance with another embodiment of the instant invention.
Figure 6:
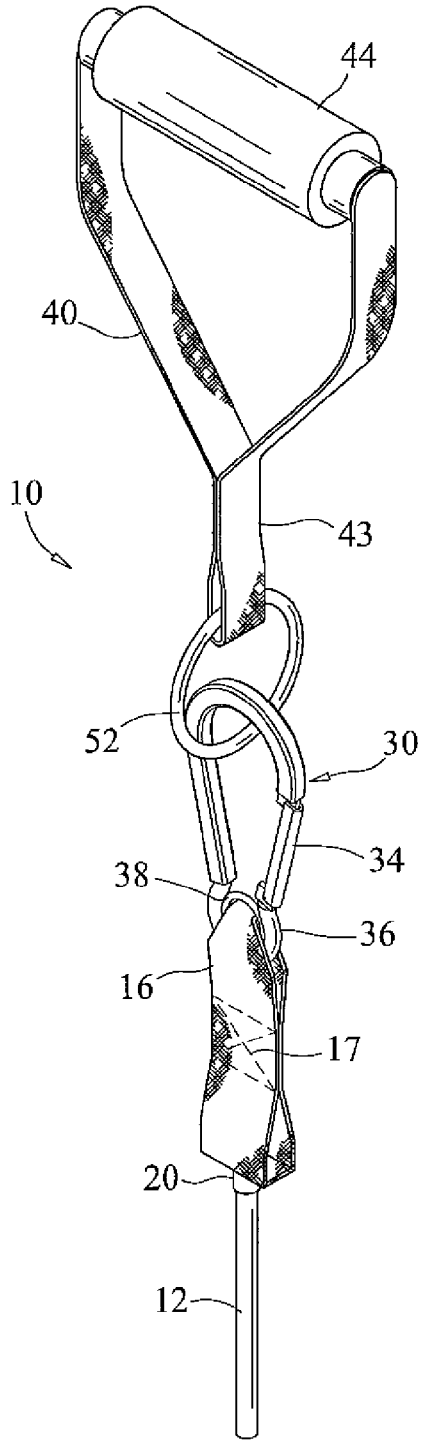
FIG. 6 is a perspective view of the resistance training exercise device with a handle in accordance with another embodiment of the instant invention.

Referring to FIGS. 3 and 4, the tethers 16 are each secured to its respective end of the cord 12 by a grommet 19, plug 18 and strain-relief sleeve 20. The plug 18 is inserted in the hollow passage 13 of each cord 12 proximal one end to block the grommet 19 from slipping off the cord. The sleeve 20 fits tightly over the end of the cord 12 containing the plug 18 to reinforce the cord 12 and plug 18 and increase its stress and strain tolerance. The sleeve 20 preferably comprises an elastic sleeve that stretches and mounts over the cord 12 segment containing the plug 18 conforming to its shape to reinforce and increase the tolerance level of stress, strain and, or sheering forces, as shown in FIG. 3. In an alternative embodiment, the sleeve 20 may be formed by and comprise a portion of the cord 12 folded back over its segment containing the plug 18 in a to manner that conforms to the cord 12 and plug 18 to enhance the tolerance level of strain, stress and, or sheer forces, as shown in FIG. 4.

With reference to FIGS. 1-9, the clips 30 comprise a hooked body 32, a spring-loaded or biasing member 34 pivotally secured in or over the opening of the hook body 32 to a smaller tether-connecting end 36 having an opening or aperture that receives and supports a corresponding end of the tether 16. The tether end 36 may contain an o-ring 38 in its opening that receives the same tether end for reinforcement and smooth support of the tether 16 in a manner that reduces friction and the risk of damage during exercise. Access to the opening in the clip 30 is controlled by the biasing member 34, which facilitates clipping to a handle 40 or strap 50. The handle o-ring 42 or strap o-ring 52 passes through the biasing member 34 and slides over the clip body 32.

Figure 7:
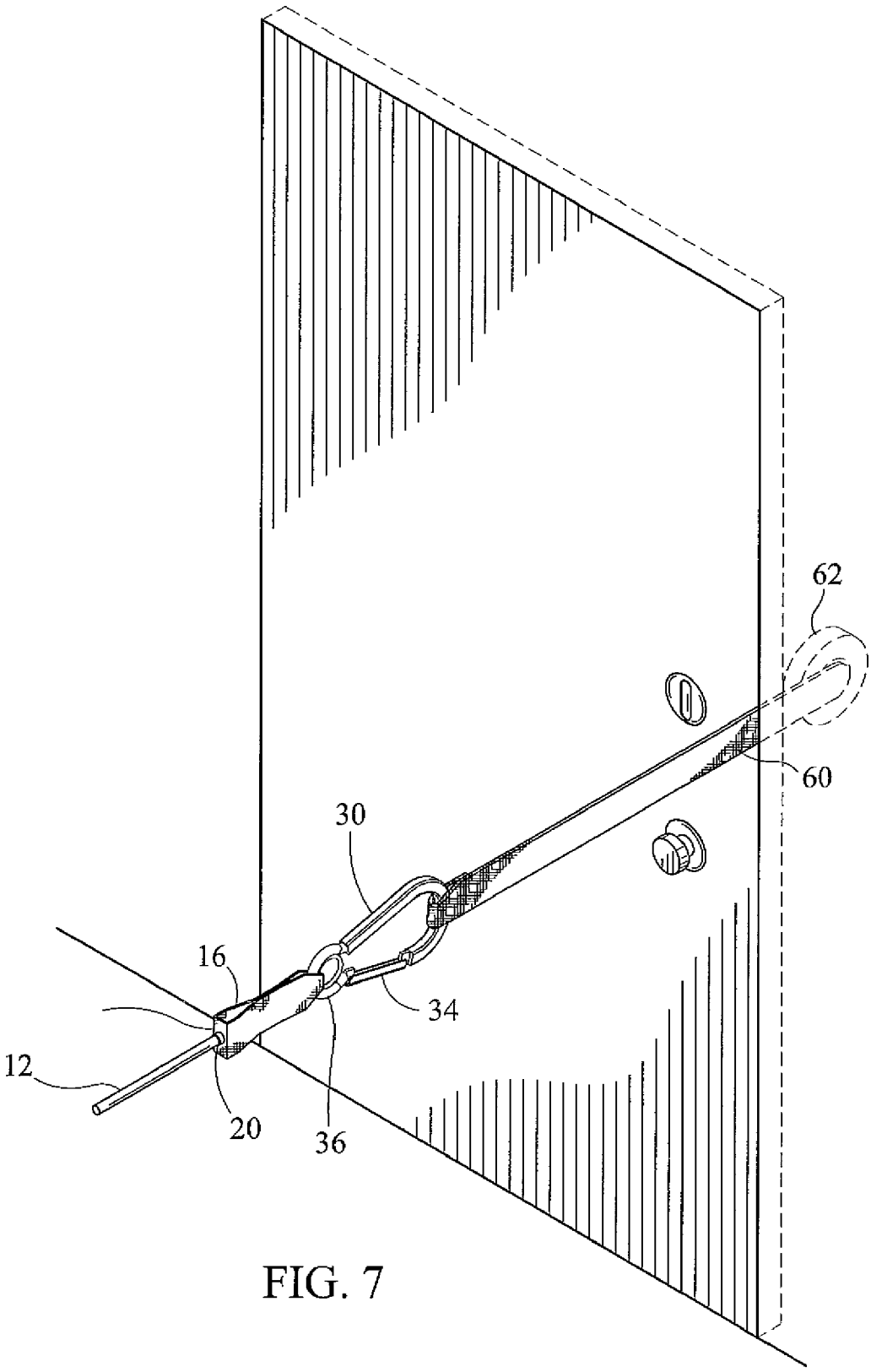
FIG. 7 is a perspective view of the resistance training exercise device with an anchor strap secured to a door in accordance with another embodiment of the instant invention.

With reference to FIGS. 1-9, the resistance training exercise system 10 of the instant invention comprises a plurality of cords 12 with a tether 16 and clip 30 at each end, plurality of handles 40 and plurality of ankle or wrist straps 50, bars and, or ropes. The system 10 may comprise an anchor strap 60 with an anchor 62, as shown in FIG. 7. As shown, the anchor 62 comprises a disk secured by or mounted to the anchor end of the strap 60. Each cord 12 comprises a different level of elasticity resistance or tension force measured in pounds for facilitating various levels of resistance in accordance with desired workouts. Each cord 12 is preferably color coded to indicate the "weight" of the cord 12, which may also be set forth by indicia 31 on the clip 30. The system of the instant invention 10 may further comprise a travel bag, user manual, workout guide and, or training video or DVD.

Figure 8:
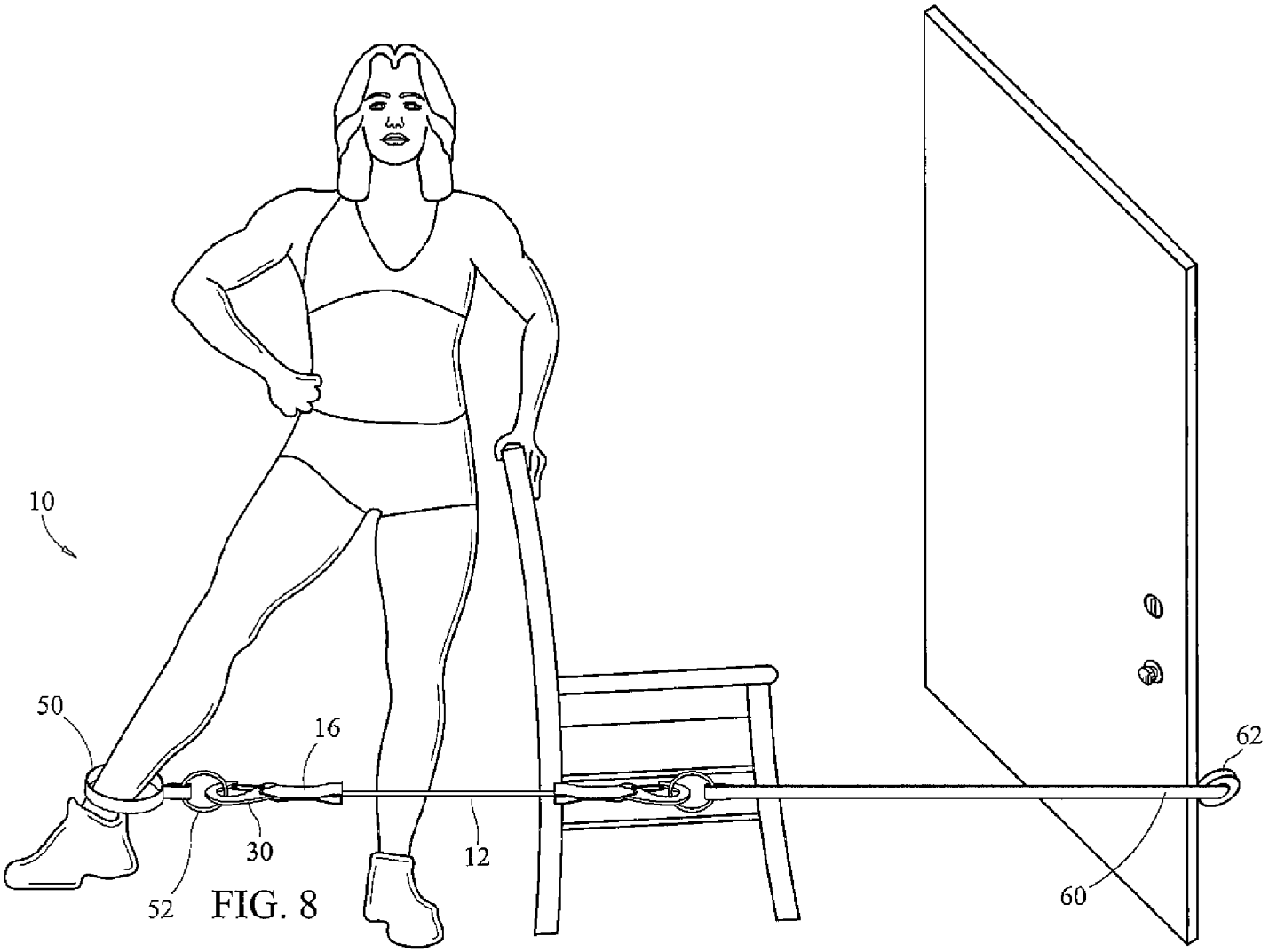
FIG. 8 is a perspective view of the resistance training exercise device with an ankle or wrist strap in use in accordance with another embodiment of the instant invention.
Figure 9:
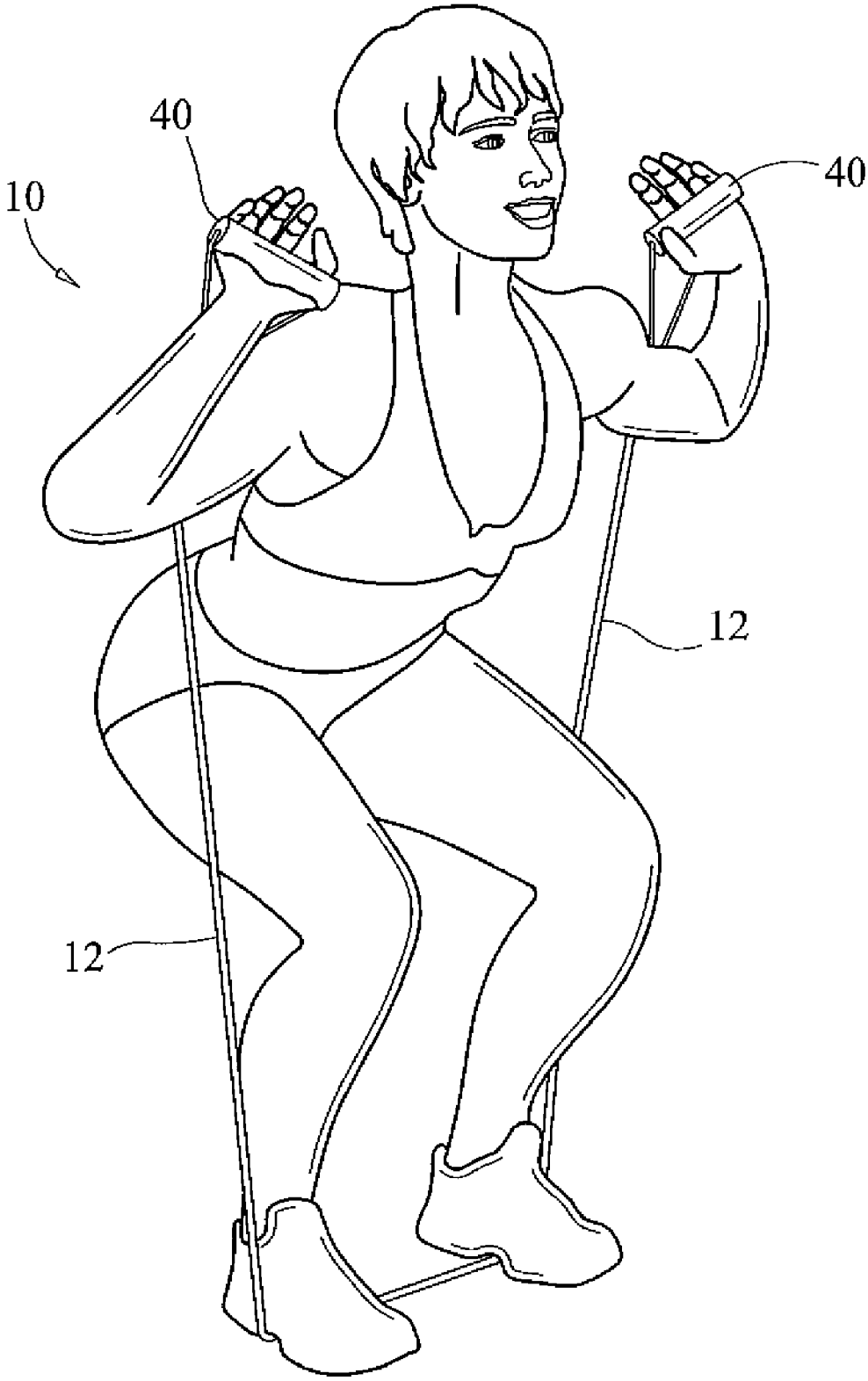
FIG. 9 is a perspective view of the resistance training exercise device with a handle in use in accordance with another embodiment of the instant invention.

With reference to FIGS. 8 and 9, the resistance training exercise method 10 of the instant invention comprises various exercises utilizing one or more cords 12 and one or more handles 40, ankle/wrist straps 50 or anchor straps 60 and anchors 62. The handles 40 are used for stretching the cord with the hands. The straps 40 are mounted to the wrists or ankles for stretching the cord. The anchor strap 60 may be mounted to a hook, door strap or door knob or to an anchor 62, as shown in FIG. 7. The user first determines the exercise to be performed. The user may reference the manual and guide for determining and designing exercise routines. Based on the exercise, the appropriately weighted cord 12 and handles 40 or straps 50 or 60 are selected and clipped to the tether 16 by the clips 30. The cord 12 may be wrapped around a secure stationary object and clipped to itself with the clip 30. The cord 12 may be threaded through a loop of a door or anchor strap 60 and to handles 40 or ankle straps 50. Once the cord 12 is properly prepared, a variety of exercises may be performed by stretching the cord and slowing retracting the cord so as to controllably release tension. For instance, the user may grasp a handle 40 with each hand and stretch and slowly retract the cord's 12 tension across the chest, or stand in the middle of the cord 12 and stretch the cord 12 upward and outward. The user may clip one end of the cord 12 to a door handle or hook and grasp a handle 40 at the other end with one hand while repeatedly stretching the cord 12 with a pulling motion. The user may clip one end of the cord 12 with the clip 30 to a door handle and secure a strap 50 to the other cord clip 30 at the opposite end and place it around an ankle or wrist for repeatedly stretching the cord 12 by moving the leg or arm outward. The cord 12 may be wrapped around a stationary object and secured by engaging the corresponding clip 30 with the cord 12, while a handle 40 or strap 50 is clipped at the opposite end.

With reference to FIGS. 10-21C, the alternative embodiments of the instant invention 10 comprise an elastic, elongated and hollow cord 12, a tether 16 secured to each end of the cord 12, a clip 30*a* and a limit band 80 secured within the elastic cord 12 to limit the stretching of the cord 12 to a predetermined length to prevent the elastic cord 12 from breaking. The limit band 80 comprises a thin fabric or semi-elastic material having substantially less elasticity or being substantially inelastic to stop the elastic cord from stretching beyond its break point or some other predetermined stretch point limit. The limit band 80 has a higher tensile strength than the elastic cord 12 to stop the cord from stretching without the band 80 breaking. The limit band 80 preferably has some elasticity so it does not bunch up in the cord 12 when it is relaxed.

Figure 10:
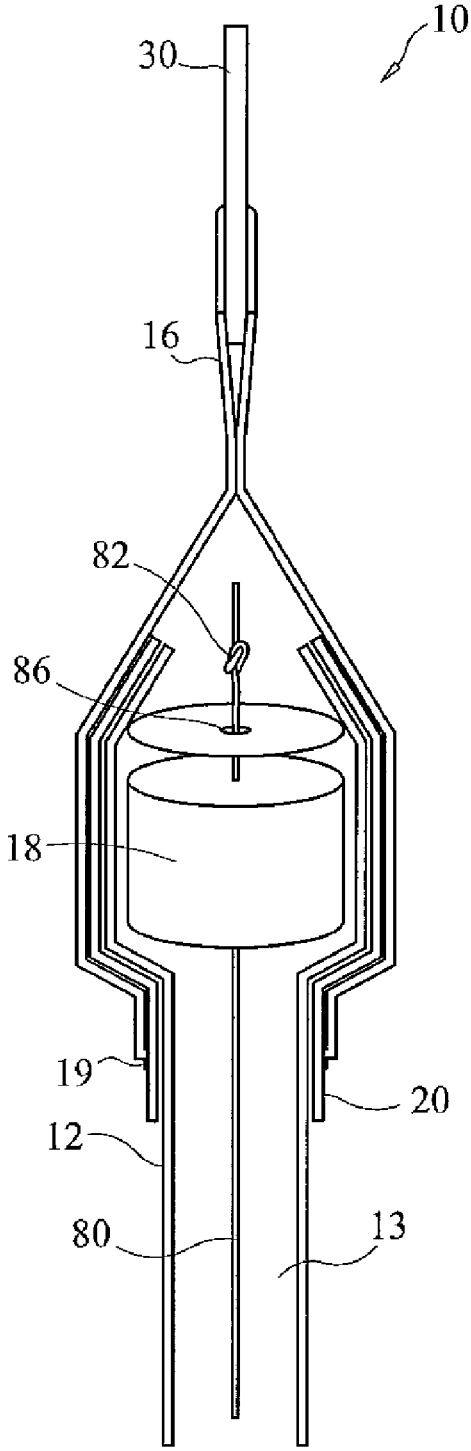
FIG. 10 is a partial cross-sectional view and perspective view of the resistance training exercise device illustrating the limit band inside the elastic cord in accordance with an alternative embodiment of the instant invention.

Still referring to FIGS. 10-21C, the limit band 80 may be secured in the elastic band 12 through the plug 18, to the plug 18 or to a clip 30, handle 40 or loop 70. With reference to FIG. 10, the limit band 80 disposed in the cord 12 is preferably secured through the plug 18 by passing it through a channel formed in the plug 18 and tying the end of the band 80 into a knot 82 or securing it to a knob-like object. The preferred embodiment of the resistance training device 10 with a limit band 80, also comprises a metal or plastic washer 84 having a center aperture 86 through which the band 80 passes. The washer 84 provides reinforcement to the plug 18 and structural integrity and has a center aperture 86 that is smaller than the knot or knob 82. With reference to FIG. 12, in another alternative embodiment, the resistance training device 10 with a limit band 80 includes a rigid cylinder 88 in the center of the plug 18. The limit band 80 passes through the cylinder 88. The cylinder 88 reduces friction and prevents the band 80 from rubbing against the plug 18, thereby reducing wear and tear. The cylinder 88 also structurally reinforces the plug 18.

Figure 11:
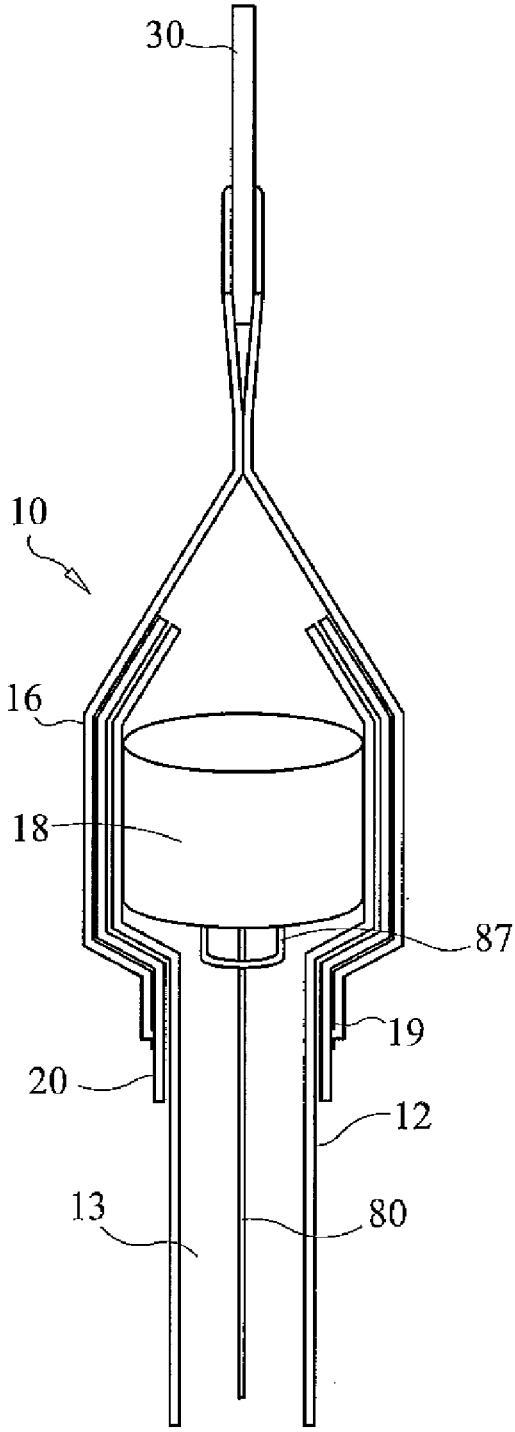
FIG. 11 is a partial cross-sectional view and perspective view of the resistance training exercise device illustrating the limit band inside the elastic cord with hook for attaching the band to the plug in accordance with an alternative embodiment of the instant invention.
Figure 12:
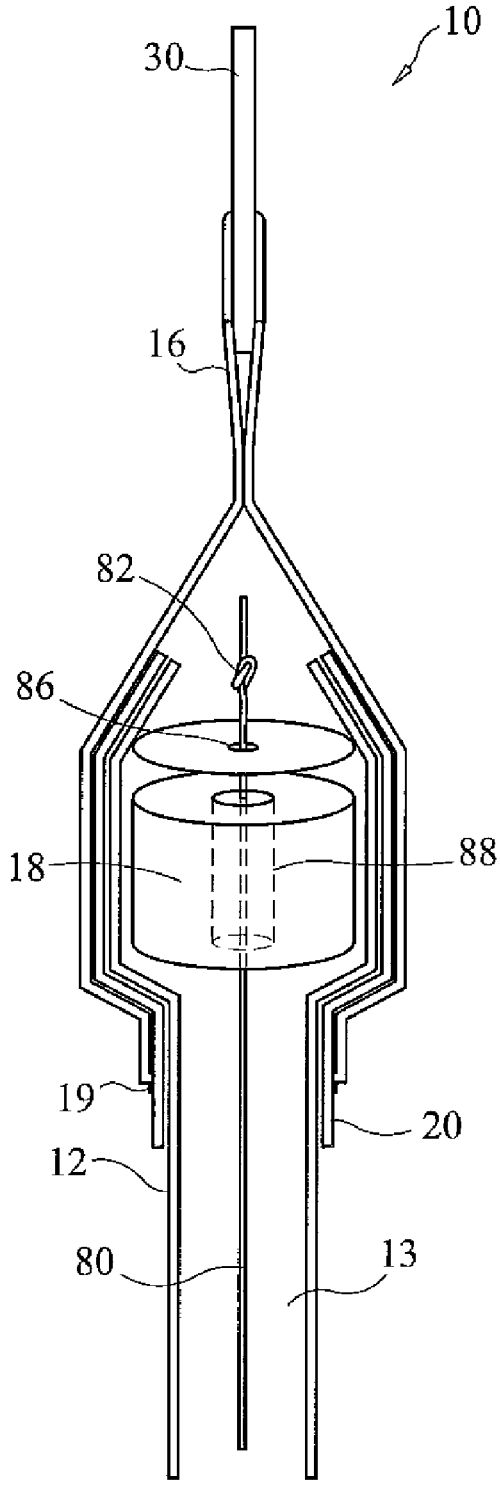
FIG. 12 is a partial cross-sectional view and perspective view of the resistance training exercise device illustrating the limit band inside the elastic cord and a protective cylinder inside the plug in accordance with an alternative embodiment of the instant invention.

With reference to FIG. 11, in another alternative embodiment, the resistance training device 10 with a limit band 80 comprises a plug 18, a hook 87 attached or secured to the bottom end of the plug 80 and a limit band 80 attached to the hook 87. The band 80 may also be attached to the plug 18. In this embodiment, the plug 18 may alternatively include a cylinder 88, as described herein.

Figure 13:
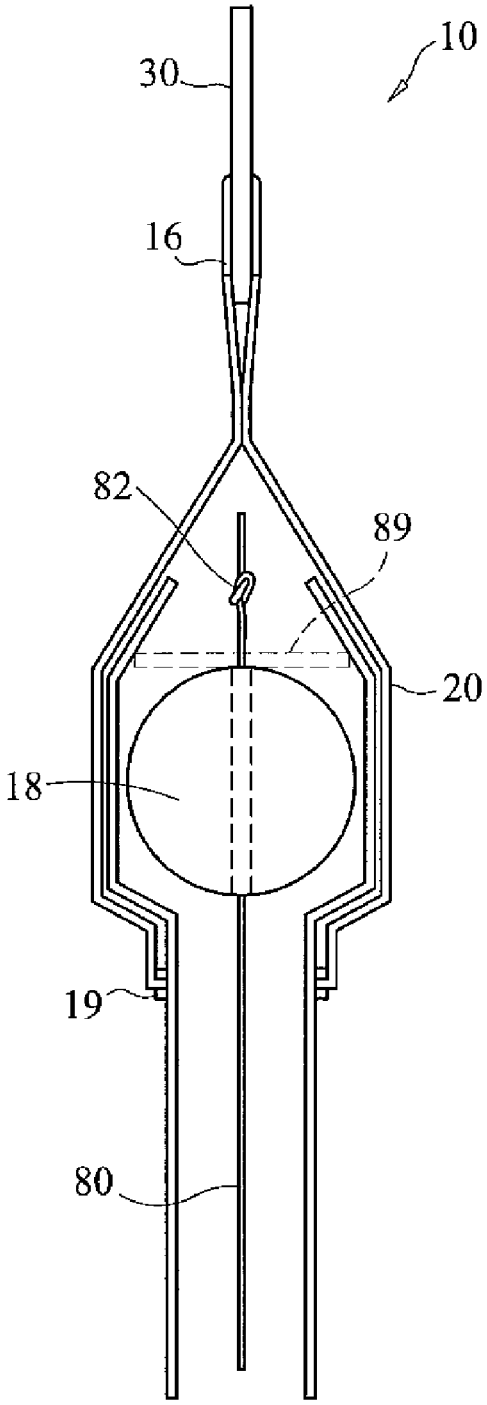
FIG. 13 is a partial cross-sectional view and elevational view of the resistance training exercise device illustrating the limit band inside the elastic cord and a ball stopper and the limit band passing through the ball in accordance with an alternative embodiment of the instant invention.

With reference to FIG. 13, in another alternative embodiment, the resistance training device 10 with a limit band 80 comprises a spherical or spherical-like plug 18. The limit band 80 disposed in the cord 12 is secured through the spherical plug 18 by passing it through a channel formed in the plug 18 and tying the end of the band 80 into a knot 82 or securing it to a knob-like object. In this embodiment, the spherical plug 18 may alternatively include a cylinder 88 and, or washer 89, as described herein.

Figure 14:
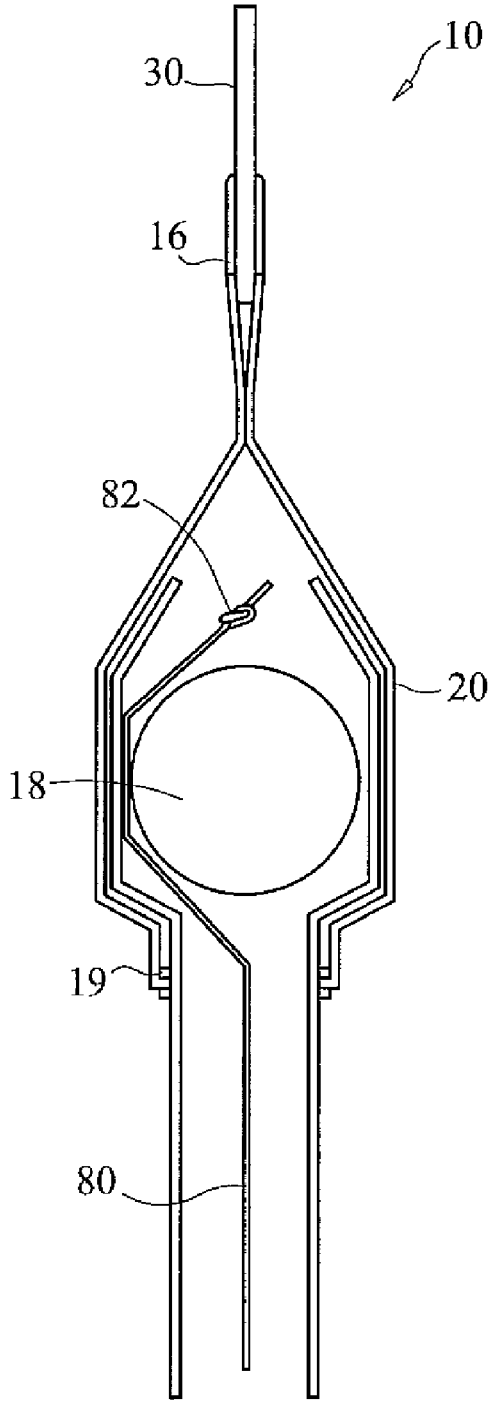
FIG. 14 is a partial cross-sectional view and elevational view of the resistance training exercise device illustrating the limit band inside the elastic cord and a ball stopper and the limit band passing around the ball in accordance with an alternative embodiment of the instant invention.

With reference to FIG. 14, in another alternative embodiment, the resistance training device 10 with a limit band 80 comprises a spherical or spherical-like plug 18. The limit band 80 disposed in the cord 12 is disposed outside the spherical plug 18 and secured by tying the end of the band 80 into a knot 82 or securing it to a knob-like object. In this embodiment, the band 80 is sandwiched between the plug 18 and elastic cord 12.

Figure 15:
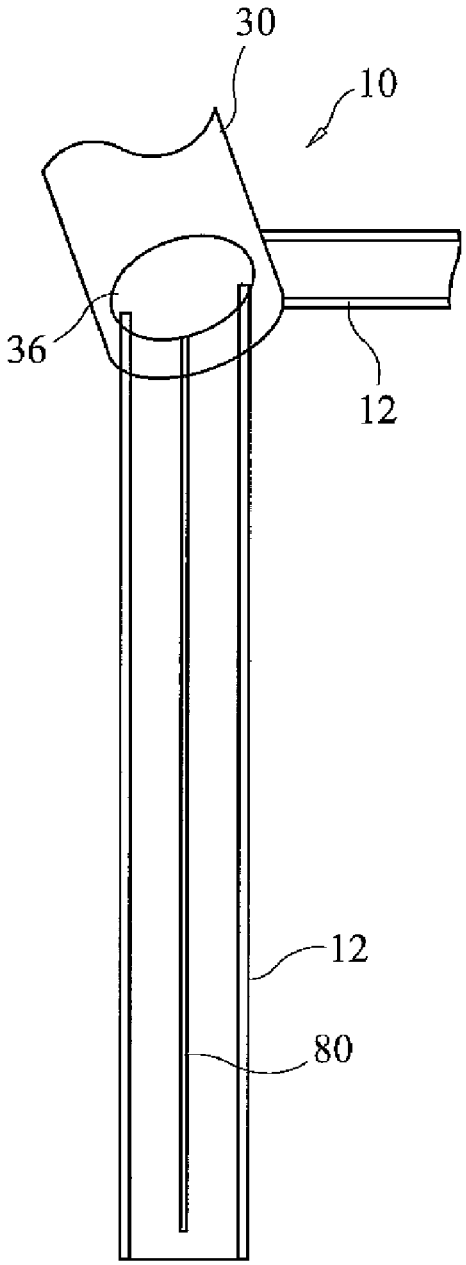
FIG. 15 is a diagram and partial elevational view of the resistance training exercise device illustrating the limit band inside the elastic cord and secured to an opening to a clip or handle in accordance with an alternative embodiment of the instant invention.
Figure 16:
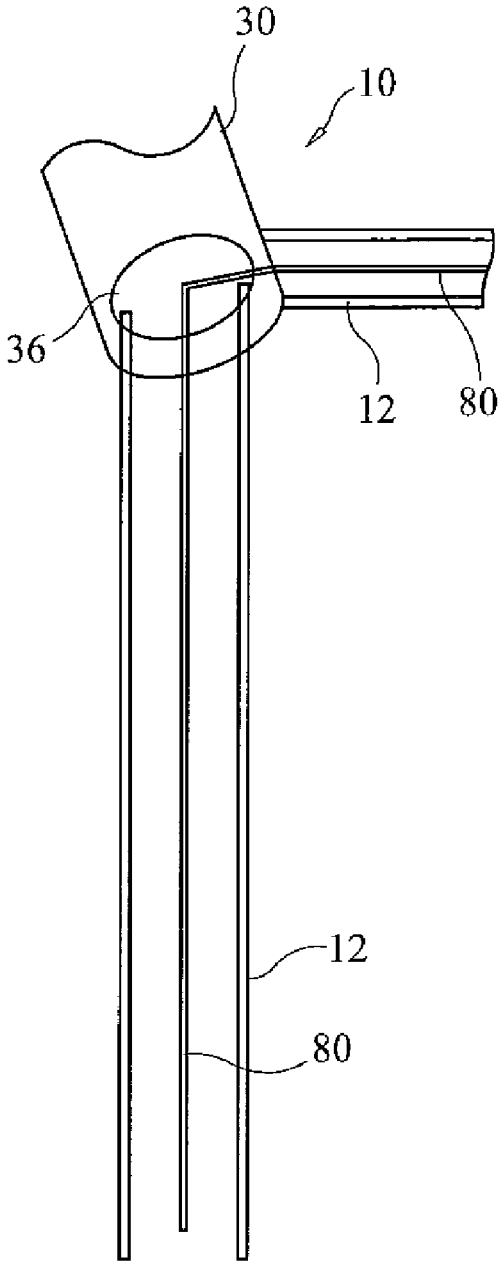
FIG. 16 is a diagram and partial elevational view of the resistance training exercise device illustrating the limit band inside the elastic cord and secured through an opening to a clip or handle in accordance with an alternative embodiment of the instant invention.

With reference to FIG. 15, in another alternative embodiment, the resistance training device 10 comprises a limit band 80 disposed in the cord 12 and secured directly to the lower end of the clip 30 and clip lower end aperture 36, handle 40 or loop 70. With reference to FIG. 16, the resistance training device comprises a limit band 80 disposed in the cord 12 and passing through the clip lower end aperture 36 for attachment to the clip 30, handle 40 or loop 70.

Figure 17:
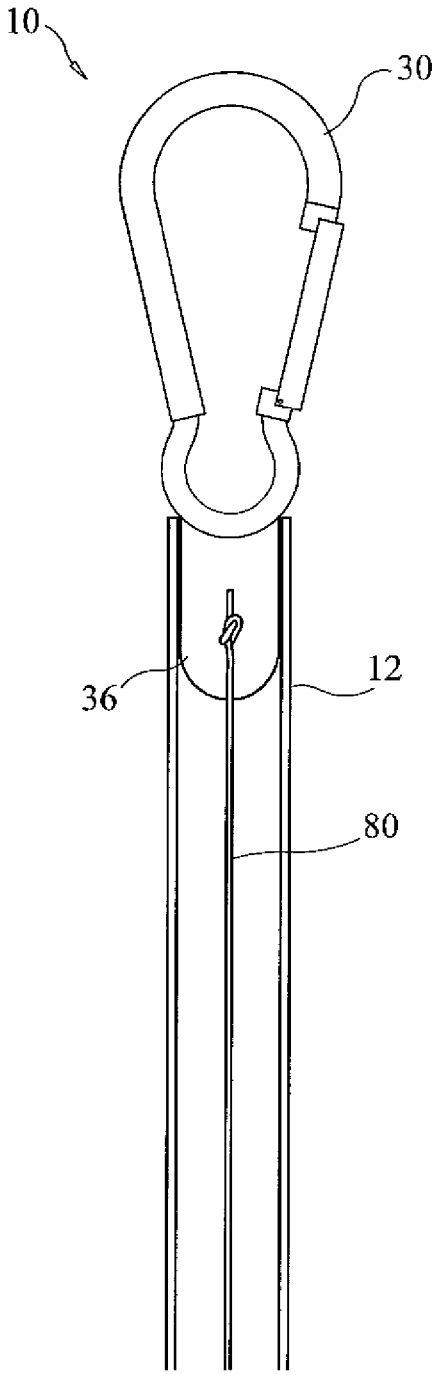
FIG. 17 is a diagram and partial elevational view of the resistance training exercise device illustrating the limit band inside the elastic cord and secured through an opening to a post of a clip in accordance with an alternative embodiment of the instant invention.

With reference to FIG. 17, in another alternative embodiment, the resistance training device 10 with a limit band 80 comprises a clip 30, handle 40 or loop 70 secured directly to the limit band 80. The limit band 80 disposed in the cord 12 is to the aperture 36 at the lower end of the clip 30, handle 40 or loop 70.

Figure 18:
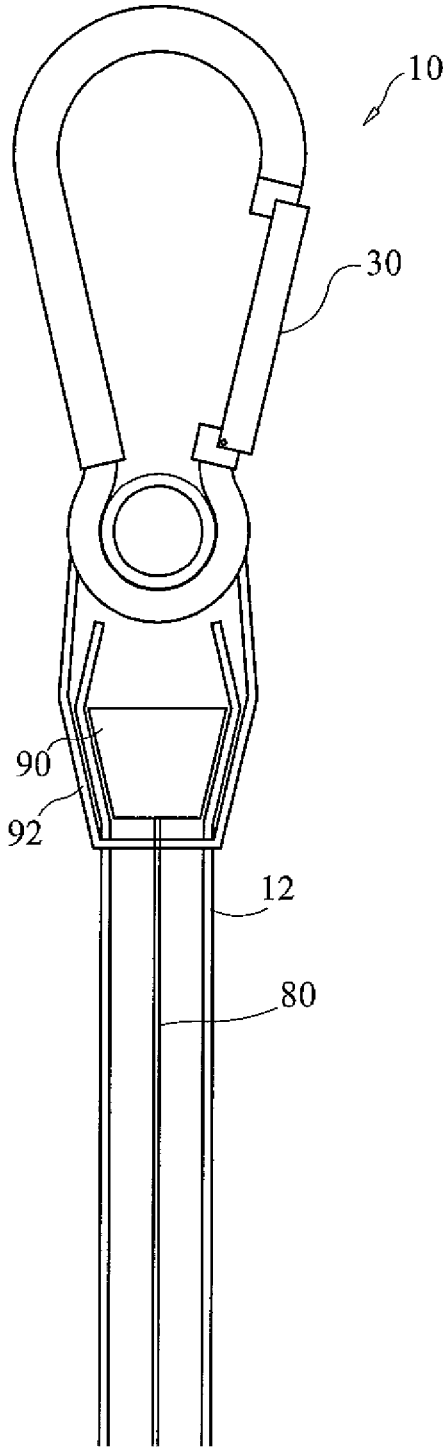
FIG. 18 is a diagram and partial elevational view of the resistance training exercise device illustrating the limit band inside the elastic cord and secured to a tapered plug in accordance with an alternative embodiment of the instant invention.

With reference to FIG. 18, in another alternative embodiment, the resistance training device 10 with a limit band 80 comprises a clip 30, tapered adapter 92 extending from the clip 30, tapered plug 90 disposed in the adapter 92 and limit band 80 secured to the tapered plug 92.

The elastic cord 12 penetrates the adapter 92 between the tapered plug 90 and interior walls of the adapter 92 such that the cord 12 is secured to the clip 30 within the adapter 92. In other alternative embodiments, the clip 30 may be replaced with a handle 40 or loop 70.

Figure 19:
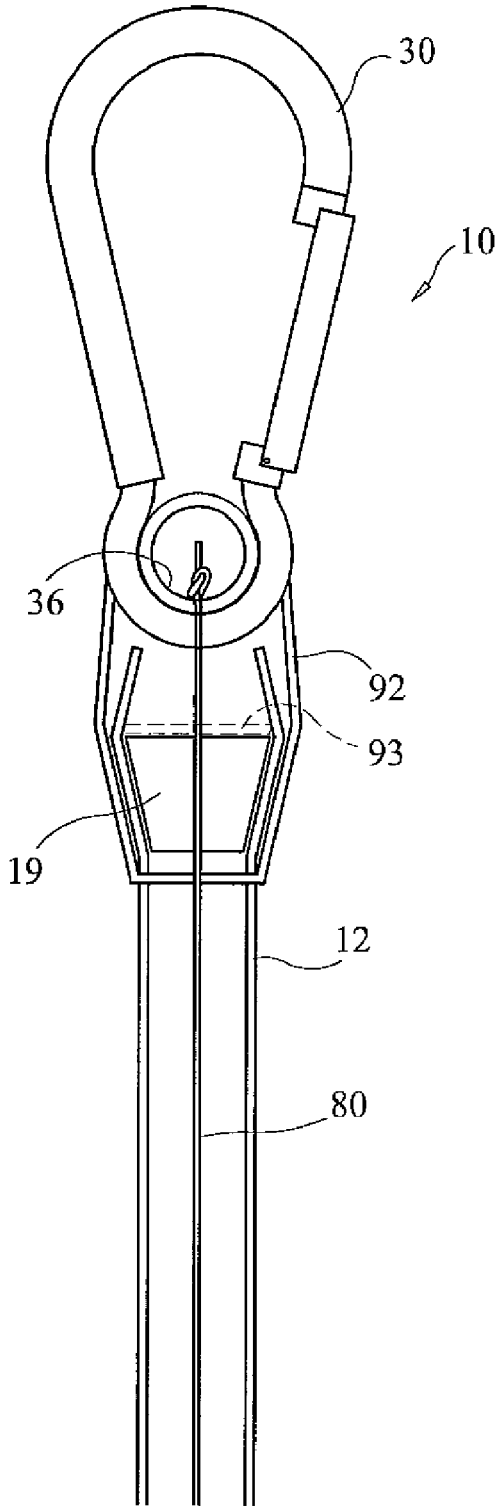
FIG. 19 is a diagram and partial elevational view of the resistance training exercise device illustrating the limit band inside the elastic card and secured to the clip through a tapered plug in accordance with an alternative embodiment of the instant invention.
Figure 20:
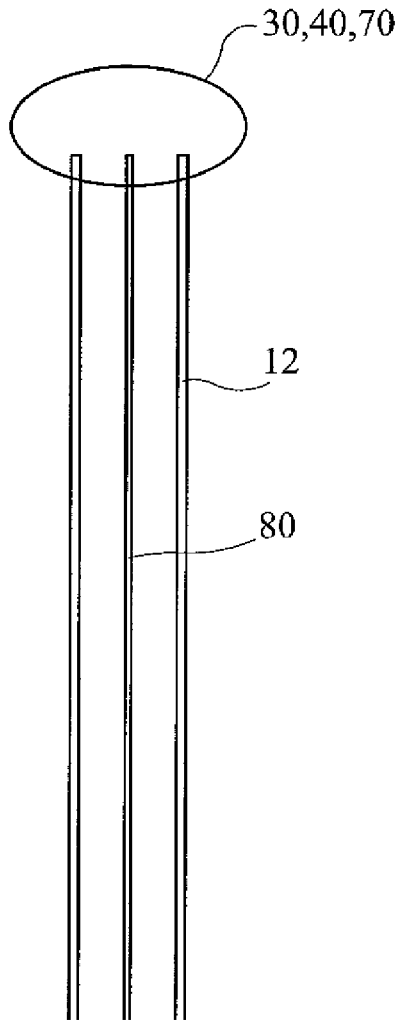
FIG. 20 is a diagram and partial elevational view of the resistance training exercise device illustrating the limit band inside the elastic cord and secured to a clip, strap or handle in accordance with an alternative embodiment of the instant invention.
Figure 21C:
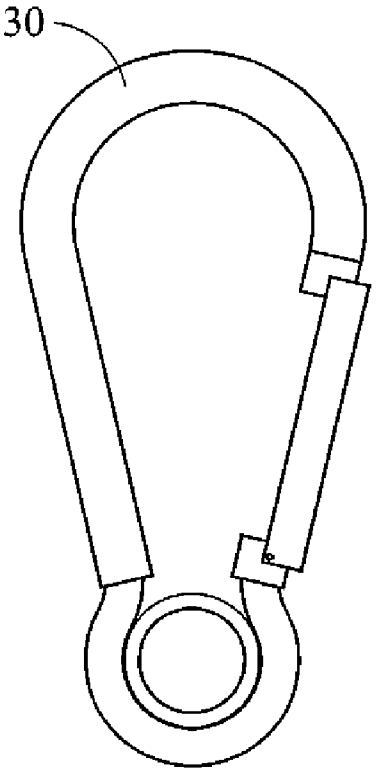
FIG. 21A-C are diagrams and partial elevational views of the handle, strap and clip used in accordance with the preferred and alternative embodiments of the instant invention.
Figure 21B:
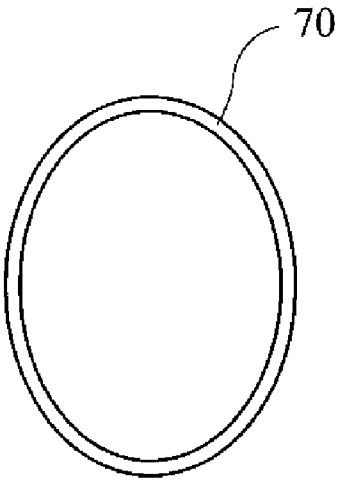
Figure 21A:
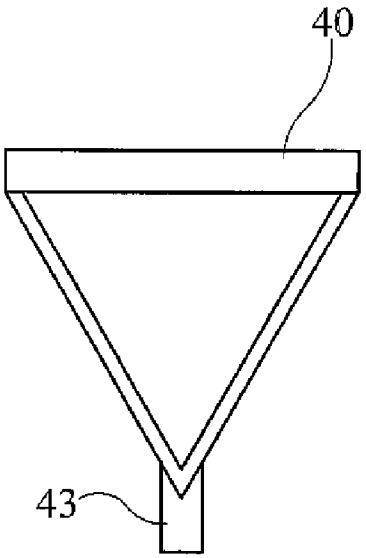

With reference to FIG. 19, in another alternative embodiment, the resistance training device 10 with a limit band 80 comprises a clip 30, handle 40 or strap 70, tapered adapter 92 extending from the clip 30, tapered plug 90 disposed in the adapter 92 and limit band 80 passing through a channel formed in the tapered plug 92 and secured to the lower end aperture 36 of the clip 30. The elastic cord 12 penetrates the adapter 92 between the tapered plug and interior walls of the adapter 92 such that the cord 12 is secured to the clip 30 within the adapter 92. The tapered plug 90 may include a cylinder 88 passing through the center of the plug 90 to form a passage with less friction. In this embodiment, the spherical plug 18 may alternatively include a cylinder 88 and, or washer 93, as described herein. In all embodiments, the clip 30 may be replaced with a handle 40 or loop 70, as depicted in FIG. 20. With reference to FIG. 21A-C, the instant invention is adapted for clips 30, handles 40 and loop 70.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. An exercise device comprising:

a stretchable cord having opposing first and second ends, said cord having an internal cavity and an external surface;

at least two sleeves, each of said sleeves being placed over said external surface of said cord adjacent said first and second ends of said cord, each of said plugs being situated within a length of each of said sleeves;

at least two tethers, each of said tethers having a stitched portion, said stitched potion forming two opposing compartments, a first compartment having at least one grommet and is designed to receive at least one end of said cord with said sleeve, said grommet having a circumference that is smaller than a circumference of said cord with said sleeve, at least a portion of said cord and at least a portion of said sleeve being situated generally within said first compartment of said tether;

at least two carabineers, each of said carabineers having a bottom portion and a gate element;

at least two O-rings situated entirely within each of said bottom portions of each of said carabineers, each of said O-rings is designed to receive a portion of said second compartment of each of said tethers;

at least one limit band situated within said internal cavity of said cord; and a means for securing said limit band within said internal cavity of said cord, said means being situated within said cord and said sleeve.

2. The device of claim 1 wherein said stitched portion is situated generally central of said tether, said stitched portion provides for reinforcement in strengthening said tether and said device when said cord is stretched.

3. The device of claim 1 wherein, each of said first compartments of said tether forms a loop, each of said loops is placed within each of said O-rings.

4. The device of claim 1 wherein said means for securing said limit band within said internal cavity of said cord is selected from a group consisting of dowels, plugs and combinations thereof.

5. The device of claim 1 wherein said limit band, said sleeve, said tether with said compartments and said means for securing said limit band assist in preventing said cord from breaking and snapping during stretching of said cord.

6. The device of claim 1 wherein said means for securing said limit band is situated within said first compartment of said tether and prevents said end of said cord and at least a portion of said sleeve from passing said grommet when said cord is stretched.

7. The device of claim 4 wherein said limit band has opposing ends, at least one end of said limit band is secured to said means for securing said limit band within said internal channel of said cord.

8. The device of claim 7 wherein said means for securing said limit band comprises a channel and one of said ends of said limit band passes through channel and secured to said means.

9. A resistance exercise device comprising:

a stretchable cord having opposing first and second ends, said cord having an internal cavity and an external surface;

at least one plug being inserted within said internal cavity of said cord adjacent said first end of said cord;

at least one sleeve being placed over said external surface of said cord adjacent said first end of said cord, said plug being situated within a length of said sleeve;

at least one tether having a stitched portion, said stitched potion forming two opposing compartments, a first compartment having at least one grommet and is designed to receive at least one end of said cord with said sleeve and said plug, said plug with at least a portion of said cord and at least a portion of said sleeve being situated generally within said first compartment of said tether, said second compartment forming a loop;

at least one carabineer having a bottom portion and a gate element;

at least one O-ring situated entirely within said bottom portion of said carabineer, said O-ring being designed to receive a portion of said second compartment of said tether; and at least one limit band situated within said internal cavity of said cord, said limit band having opposing ends, at least a portion of said first end of said limit band is secured to said plug.

10. The device of claim 9 further comprising a second plug and a second sleeve, said second plug being inserted within said internal cavity of said cord adjacent said second end of said cord, said second sleeve being placed over said external surface of said cord adjacent said second end of said cord, said second plug being situated within a length of said second sleeve, said second end of said limit band is secured to said second plug.

11. The device of claim 10 further comprising a second tether having a stitched portion, said stitched potion forming two opposing compartments, a first compartment having at least one grommet and is designed to received at least one end of said cord with said second sleeve and said second plug, said second plug with at least a portion of said cord and at least a portion of said second sleeve being situated generally within said first compartment of said tether, said second compartment forming a loop.

12. The device of claim 11 further comprising a second carabineer having a bottom portion and a gate element.

13. The device of claim 12 further comprising at least two O-ring, each O-ring being entirely situated within said bottom portion of each of said carabineers, said O-rings are designed to receive a portion of each of said loops of said second compartments of said tethers.

14. The device of claim 9 wherein said plug comprises a channel and one of said ends of said limit band passes through channel and secured to said means.

15. The device of claim 14 further comprising a washer situated adjacent said plug when said limit band is secured to said plug.

16. The device of claim 9 wherein said plug secures said limit band within said cord and said sleeve.

17. The device of claim 9 further comprises an apparatus designed to be attached to said carabineer for providing multiple exercise options, said apparatus being selected from a group consisting essentially of handles, loops, straps, bands, rings, rope, grips and combinations thereof.

18. The device of claim 9 wherein said tether comprises straps.

19. The device of claim 9 further comprising a plurality of combinable devices to form a system.

20. A resistance exercise device comprising:

a stretchable cord having opposing first and second ends, said cord having an internal cavity and an external surface, each of said first and second ends being folded over itself to create double layered ends;

at least one plug being inserted within said internal cavity of said cord adjacent said first end of said cord, said plug being situated within a length of said double layered cord;

at least one tether having a stitched portion, said stitched potion forming two opposing compartments, a first compartment having at least one grommet and is designed to receive at least one end of said cord with said plug, said plug with at least a portion of said cord and at least a portion of said double layered cord being situated generally within said first compartment of said tether, said second compartment forming a loop;

at least one carabineer having a bottom portion and a gate element; and at least one O-ring situated entirely within said bottom portion of said carabineer, said O-ring being designed to receive a portion of said second compartment of said tether; and at least one limit band situated within said internal cavity of said cord.

21. A resistance exercise device comprising:

a stretchable cord having opposing first and second ends, said cord having an internal cavity and an external surface;

at least two sleeves, each of said sleeves being placed over said external surface of said cord adjacent said first and second ends of said cord, each of said plugs being situated within a length of each of said sleeves;

at least two tethers, each of said tethers having a stitched portion, said stitched potion forming two opposing compartments, a first compartment having at least one grommet and is designed to receive at least one end of said cord with said sleeve, said grommet having a circumference that is smaller than a circumference of said cord with said sleeve, at least a portion of said cord and at least a portion of said sleeve being situated generally within said first compartment of said tether;

at least two carabineers, each of said carabineers having a bottom portion and a gate element;

at least two O-rings situated entirely within each of said bottom portions of each of said carabineers, each of said O-rings is designed to receive a portion of said second compartment of each of said tethers; and at least one limit band situated within said internal cavity of said cord, said limit band having opposing ends, at least one end of said limit band being attached to said bottom portion of one of said carabineers.

* * * * *